United States Patent [19]

Larson et al.

[11] 4,330,588

[45] May 18, 1982

[54] PROCESS FOR MODIFYING THE SURFACES OF POLYESTER FIBERS

[75] Inventors: Wayne K. Larson, Maplewood; Michael M. Lynn, White Bear Lake; E. Steven McAllister, St. Paul, all of MN

[73] Assignee: Minnesota Mining and Manufacturing Company, St. Paul, Minn.

[21] Appl. No.: 146,149

[22] Filed: May 2, 1980

[51] Int. Cl.[3] ..... B05D 3/02; B32B 7/00; B32B 23/00; B32B 27/00

[52] U.S. Cl. ..... 428/264; 427/393.4; 427/336; 428/265; 428/288; 428/290; 528/293; 528/295

[58] Field of Search ..... 528/295, 293; 260/29.2 E; 427/393.4, 336; 428/480, 481, 264, 265, 288, 290

[56] References Cited

U.S. PATENT DOCUMENTS

| | | | |
|---|---|---|---|
| 3,416,952 | 12/1968 | McIntyre et al. . | |
| 3,619,269 | 11/1971 | McIntyre et al. . | |
| 3,624,034 | 11/1971 | Price et al. . | |
| 3,779,993 | 12/1973 | Kibler et al. . | |
| 3,821,281 | 6/1974 | Radlmann et al. . | |
| 3,959,230 | 5/1976 | Hays . | |
| 4,052,368 | 10/1977 | Larson . | |
| 4,156,073 | 5/1979 | Login | 528/295 |
| 4,168,145 | 9/1979 | Hintermeier et al. | 528/293 X |

FOREIGN PATENT DOCUMENTS

| | | |
|---|---|---|
| 1088984 | 10/1967 | United Kingdom . |

*Primary Examiner*—Michael R. Lusignan

*Attorney, Agent, or Firm*—Cruzan Alexander; Donald M. Sell; Lorraine R. Sherman

[57] ABSTRACT

Shaped polyester articles having their surfaces modified with a stain-releasing finish and a process for modifying those surfaces are disclosed. The process subjects the polyester to a water-dispellable non-crystalline polymeric compound in an aqueous swelling environment.

25 Claims, No Drawings

PROCESS FOR MODIFYING THE SURFACES OF POLYESTER FIBERS

TECHNICAL FIELD

This invention relates to a surface-modifying treatment of shaped articles, particularly to shaped articles comprising polyester, the treatment providing the article with a durable stain-releasing finish.

BACKGROUND ART

The treatment of polyester to impart to it stain-release properties is well known in the art. The most common polyester used as fibers is polyethylene terephthalate which possesses a hydrophobic character, making its laundering (particularly as regards oily soil and oily stains) difficult. This is due in large part to the inherent low wettability of the polyester fibers. Oily soil or stain is difficult to remove in an aqueous laundering process since the oily material tends to become attached to the hydrophobic, or oleophilic, fibers. U.S. Pat. No. 3,959,230 describes a number of approaches used in the prior art to increase the hydrophilic character of polyester-containing fibers. Many of these approaches involve treating the surfaces of shaped polyester articles with copolymers of terephthalic acid and polyethylene glycol. The purpose of this treatment is to provide the polyester with a hydrophilic finish to reduce the tendency of the polyester to retain oily stains. U.S. Pat. No. 3,959,230 states that prior art approaches have generally been unsuccessful in soil-release performance due to lack of durability and marginal-to-unsatisfactory soil-release performance. These polymers apparently lack the necessary performance to polyester fibers under common laundering conditions, and the patentee teaches a polyester soil-release agent having durability to polyester comprising repeating units of ethylene terephthalate and polyethylene oxide terephthalate at a molar ratio of ethylene terephthalate units to polyethylene oxide terephthalate units of from about 25:75 to about 35:65, said polyethylene oxide terephthalate containing polyethylene oxide having a molecular weight of from about 300 to 700, the molecular weight of said soil-release polymer being in the range of from about 25,000 to about 55,000 and the melting point of said polymer being below 100° C.

British Pat. No. 1,088,984 and its U.S. counterparts, U.S. Pat. Nos. 3,416,952 and 3,619,269 disclose the surface-modifying treatment of shaped articles made from essentially linear crystalline polyester with agents which co-crystallize with the crystalline polyester segments of the fibers. The agent of this patent is a water-insoluble crystallizable polymeric compound being characterized in that:

(A) it has a crystalline melting point above 100° C., measured by the temperature of disappearance of birefringence, (B) it contains crystallisable segments of repeat units identical with the repeat units forming the crystallisable portions of the shaped polyester article, and (C) it contains at least one active group linked to the crystallisable segments in (B) by groups containing ester or amide linkages, said active groups serving to modify the surface of the shaped article, said active group being selected from at least one of the following: water-solvatable polymeric polyoxylalkylene groups as hereinafter defined, acetic groups comprising sulphonic acid, phosphonic acid, carboxylic acid or ionisable salts thereof, nitrogenous basic groups or ionisable salts thereof, antioxidant groups, groups which contain silicon- or fluorine-based water-repellent groups, polymeric groups containing a plurality of alcoholic hydroxyl radicals and polymeric groups containing a plurality of —CO—NH— radicals.

British Pat. No. 1,088,984 discloses the addition of sulfonic acid and other ionic groups to impart dyeability to the polymers. The patentee does not require their use for stain-releasability.

Although British Pat. No. 1,088,984 discloses surface-modifying shaped polyester articles so as to render them antistatic and soil-releasing throughout many cleaning processes by treatment with a high concentration of a crystalline polyester polymer, and although other agents are described in the prior art for rendering polyester articles stain-releasant, it appears novel in the art to provide shaped polyester articles with a durable stain-releasing finish by treating the article with a water-dispellable non-crystalline polyester polymer.

DISCLOSURE OF INVENTION

The present invention relates to a process for providing shaped articles, particularly shaped articles of polyester, with a stain-releasing finish durable through a series of cleaning operations for removal of oily soil and stain. The invention also provides shaped articles having a stain-releasing finish produced by the above mentioned process, said shaped articles with their releasing finish being durable through a series of cleaning operations. "Shaped articles" as used herein refers to filaments, fibers, films and articles made therefrom, including fabrics. "Shaped article" may contain other materials besides polyester; for example, it may be a fabric blend of polyester with cotton fibers.

The process of the invention provides a shaped article of polyester with a durable stain-releasing finish, wherein the article is subjected to a water-dispellable non-crystalline polyester polymer in an environment that causes swelling of at least the surface of the article by a swellant and then isolating the article, wherein the water-dispellable non-crystalline polymer is a synthetic organic polyester polymer having 30–70 mole percent ethylene terephthalate units, a molecular weight of 700 to 50,000 and one equivalent of sulfonic acid or ionizable sulfonic acid salt group per 700 to 8000 grams. Using the birefringence test for crystallinity, the polymers of the invention were determined to be non-crystalline.

DETAILED DESCRIPTION OF THE INVENTION

This invention relates to surface-modified shaped polyester articles and a process therefor; wherein said shaped articles are provided with surface-modification comprising water-dispellable non-crystalline organic polyester polymers having at least 30 but no more than 70 mole percent of ethylene terephthalate units, a molecular weight of about 700 to 50,000 or more, and one equivalent weight of sulfonic acid or ionizable sulfonic acid salt group per 700 to 8000 grams. The preferred water-dispellable non-crystalline sulfonic acid or sulfonic acid group-containing polymers are water-dispellable non-crystalline polyesters containing substantially equimolar amounts of the residues of (1) 100 mole percent of dicarboxylic acids consisting essentially of (a) 0 to 65 mole percent, and most preferably 0 to 45 mole percent, aliphatic dicarboxylic acids having at least two carbon atoms between carbonyl groups and having an average of 4 to 10 carbon atoms, (b) 30 to 90 mole percent, and most preferably 40 to 70 mole percent, unsulfonated aromatic dicarboxylic acids of which at least 30 but no more than 70 mole percent is terephthalic acid, (c) 5 to 60 mole percent, and most preferably 15 to 40 mole percent, of aliphatic or aromatic dicarboxylic acids having 4 to 12 carbon atoms and having one sulfonic acid or sulfonic acid salt group, and (2) 100 mole percent of glycols consisting essentially of aliphatic glycols containing 2 to 10 carbon atoms and up to 4 non-peroxidic catenary oxygen atoms, of which glycols at least 30 mole percent is ethylene glycol.

Acid residues as used herein refer to the species remaining after removal of the active hydrogens from the acid groups. Glycol residues refer to the species remaining after removal of the OH groups from the diols.

Some of the water-dispellable non-crystalline polyester polymers useful in the present invention are disclosed in U.S. Pat. Nos. 3,779,993 and 4,052,368. The water-dispellable non-crystalline polyesters having utility in the process of the present invention are prepared by standard polyester preparative techniques involving the reaction of dicarboxylic acids, including sulfo group-containing dicarboxylic acids (and their diesters, anhydrides or halides) with monoalkylene glycols. In the final polyester polymer, 30 to 70 mole percent of the dicarboxylic acid residues are derived from terephthalic acid and at least 30 mole percent of the glycol residues are derived from ethylene glycol. The esterification reaction is carried out in the presence of acid catalysts (e.g. antimony trioxide), utilizing heat and pressure as desired. Normally, an excess of ethylene glycol is supplied and removed by conventional techniques in the later stages of polymerization. When desired, a hindered phenol antioxidant may be added to the reaction mixture to protect the polyester from oxidation. The polyesters obtained are non-crystalline having a ball-and-ring softening point in the range of 40° C. to 200° C. Generally, they are ground by conventional techniques and stored in containers sealed to exclude atmospheric moisture.

By "sulfo group" is meant a $—SO_3X$ group in which X is hydrogen or alkali metal cation, such as sodium, potassium, and lithium; alkaline earth metal cation, tertiary, and quaternary ammonium cations having zero to 18 carbon atoms, such as ammonium, hydrazonium, N-methyl pyridinium, guanidinium, methylammonium, butylammonium, diethylammonium, triethylammonium, tetraethylammonium, and benzyltrimethylammonium; monovalent cations are preferred.

Suitable sulfo-substituted dicarboxylic acids for preparation of the water-dispellable polyesters include: sulfoalkanedicarboxylic acids such as sulfosuccinic acid, 2-sulfoglutaric acid, 3-sulfoglutaric acid and 2-sulfododecanedioic acid; sulfoarenedicarboxylic acids such as 5-sulfoisophthalic acid, 2-sulfoterephthalic acid, 5-sulfonaphthalene-1,4-dicarboxylic acid; sulfobenzylmalonic acid esters such as those described in U.S. Pat. No. 3,821,281; sulfophenoxymalonate such as described in U.S. Pat. No. 3,624,034; and sulfofluorenedicarboxylic acids such as 9,9-di(2'-carboxyethyl)-fluorene-2-sulfonic acid. It is to be understood that the corresponding lower alkyl carboxylic esters of 4 to 12 carbon atoms, halides, anhydrides, and sulfo salts of the above sulfonic acids can also be used.

Suitable diols for condensation with the aforementioned sulfosubstituted dicarboxylic acids in preparing the water-dispellable polyesters are straight or branched chain alkylenediols having the formula $HO-(CH_2)_eOH$ in which e is 2 to 10 and oxaalkylenediols having a formula $H-(OR)_fOH$ in which R is an alkylene group having 2 to 4 carbon atoms and f is 2 to 4, the values being such that there are no more than 10 carbon atoms in the oxaalkylenediol. Examples of suitable diols include ethyleneglycol, propyleneglycol, 1,4-butanediol, 1,5-pentanediol, 1,6-hexanediol, 1,8-octanediol, 1,10-decanediol, 2,2-dimethyl-1,3-propanediol, 2,2-diethyl-1,3-propanediol, 3-methyl-1,5-pentanediol, diethyleneglycol, dipropyleneglycol, diisopropyleneglycol, 1,11-(3,6-dioxaundecane)diol, 1,14-(3,6,9,12-tetraoxatetradecane)diol, 1,8-(3,6-dioxa-2,5,8-trimethyloctane)diol and 1,14-(5,10-dioxatetradecane)diol.

Small amounts of polyoxyalkylenediols having molecular weights up to about 2000 may be included as reactants in the preparation of the polyester as long as the amount of polyoxyalkylenediol is kept below about 10 mole percent and 10 weight percent.

Suitable aliphatic dicarboxylic acids having the formula $HOOC(CH_2)_gCOOH$, wherein g has an average value of 2 to 8, are for example, succinic acid, adipic acid, maleic acid, glutaric acid, suberic acid, oxydipropionic acid, decanedioic acid, dodecanedioic acid and 1,4-cyclohexanedicarboxylic acid.

Useful aromatic dicarboxylic acids include terephthalic acid, isophthalic acid, phthalic acid, 1,4-naphthalenedicarboxylic acid, 1,2-naphthalenedicarboxylic acid and 1,5-pyridine dicarboxylic acid.

To provide durability to the water-dispellable polyester for use in the process of the invention, the dicarboxylic acids and diols must be chosen so that at least about 30 but not more than about 70 mole percent of the total dicarboxylic acids in the final polyester is terephthalic acid. With less than about 30 mole percent terephthalic acid the polyester is not enduring to multiple laundering processes of shaped polyester articles. With more than about 70 mole percent of terephthalic acid in the final polyester, the polyester becomes crystalline and therefore has insufficient water-dispellable character to provide the shaped article with a stain-releasable finish durable through many washings.

It is also contemplated that the water-dispellable polyesters may be chain extended by reaction with organic diisocyanates. This is accomplished by the well-known reaction of terminal hydroxyl or carboxyl groups present in water-soluble polyesters.

Suitable diisocyanates for use as chain extenders are any of the aliphatic, aromatic and heterocyclic diisocyanates known in the polyurethane field. Examples of preferred diisocyanates include 2,4-tolylene diisocyanate, 3,5,5-trimethyl-1-isocyanato-3-isocyanatomethylcyclohexane, methylene bis-(4-cyclohexylisocyanate), hexamethylene diisocyanate, and 1,3-di(isocyanatoethyl) hydantoin.

By the term "water-dispellable" non-crystalline, it is meant that the sulfonic acid or ionizable sulfonic acid salt group-containing organic polymer of use in the process of the invention is either completely soluble in water in all proportions or possesses water-dispellability in water in accordance with the test described in U.S. Pat. No. 4,052,368, column 6, lines 9-19, which test is as follows:

Water-Dispellability: Approximately 1 gram of polyester resin is put in a 125 ml jar and 99 ml of 20° C. tap water is added. A cap is placed on the jar, which is then mounted on a reciprocating shaker for 2 hours. If no pieces of resin remain, the resin is termed water-dispellable. If some pieces of the resin remain, the mixture is transferred to a 250 ml beaker and heated to about 180° F. (80° C.) for 20 minutes. If no pieces of resin then remain, the resin is deemed water-dispellable. If, however, pieces of the resin can still be discerned, the resin is considered not to be water-dispellable.

By "non-crystalline" it is meant that the organic polymer shows no crystallinity detectable by birefringence.

For use as a stain-releasing finish for shaped articles of polyester, particularly fibers or textiles containing polyester, the shaped article is brought into contact with the stain-releasing agent in an aqueous swelling environment for a time sufficient to cause swelling of at least the surface of the polyester article.

The nature of the surface-modification is not specifically understood but it is believed that there is involved a "wicking operation" in which the polyester fibers swell in the aqueous environment, during which process the polymeric stain-release agent becomes locked onto and into the fibers.

Aqueous swelling environments include water baths such as the following: textile washing baths as in mill scouring procedures, common household or commercial washing machines; textile dyeing baths; baths containing polyester swelling agents (commonly called carriers in the dye industry) such as, for example, methyl naphthalene, biphenyl, chlorinated benzene, diallyl phthalate, and others; and padding followed by steaming operation as is done in the dyeing of textile materials. These examples are merely indicative of possible swelling environments and are not meant to limit the scope of this invention in any way.

The swelling environment may be provided as part of the dyeing or fabric manufacturing processes or it may be supplied by the consumer during the laundering process. The stain-release agents of the present invention do not have to be incorporated into or onto the polyester fibers during the manufacturing process; they may be added to the fibers by the consumer during the laundering process.

Preferably, the shaped polyester article is contacted with about 0.01 to 1, preferably, 0.05 to 1.0, and more preferably 0.3 to 0.8 parts by weight of stain-releasing agent per 100 parts by weight of the polyester article. Generally, the contact is made in a bath of about 3 to about 35 parts, preferably about 8 to about 15 parts of water per part by weight of shaped article, the bath optionally containing a chemically effective amount of a swelling agent or carrier, preferably in a concentration of 1 to 15% by weight of polyester article. Satisfactory performance of the stain-release agent is readily achieved by applying the agent during the dyeing of the article without altering dyeing conditions. Typically, contact times can be from about 5 minutes to about one hour at temperatures from about 35° C. to 150° C. or higher. Generally, the longer the contact time and the higher the contact temperature in the bath, the greater the durability of the stain-release finish of the treated shaped article. Thus, in cool water fairly long contact times are required to provide stain-release to articles that are then durable through only one or two washing cycles. The durability of stain-release increases to 30 washing cycles or more on increasing contact temperature to 125° to 150° C. as in a typical pressure jet dye applicator where only 10 minutes to about an hour of contact temperatures is necessary. However, longer times of contact are not detrimental.

Contact of the shaped polyester article with the stain-release agent can be made by a padding operation. By such a process, the polyester article is padded with a solution containing sufficient chemical to deposit 0.01 to 1.0, preferably 0.05 to 1.0, and more preferably 0.3 to 0.8 parts by weight of soil release agent per 100 parts by weight of polyester article. The article is then subjected to steam at 90° to 150° C. for about 10 to 60 seconds. This process results in the stain-release agent becoming locked into and onto the polyester fibers.

The process disclosed herein anticipates the use of emulsifiers, dyeing assists and adjuvants, such as surfactants, water-softeners, bleaches and brighteners which are commonly used in laundering. Emulsifiers useful herein include any of the surface active agents of the anionic, nonionic, amphoteric or zwitterionic type. Examples of suitable anionic surface active agents are sodium salts of fatty alcohol sulfates having from 8-18 carbon atoms in the fatty chain, and sodium salts of alkyl benzene sulfonates having from 9 to 15 carbon atoms in the alkyl chain. Suitable nonionic surface active agents include the polyethylene oxide condensates of alkyl phenols, wherein the alkyl chain contains from about 6 to 12 carbon atoms and the amount of ethylene oxide condensed onto each mole of alkyl phenol is from about 5 to 25 moles. Specific examples are the condensation product of one mole of nonylphenol with 10 moles of ethylene oxide and the condensation product of one mole of $C_{12}$ fatty alcohol and 10 moles of ethylene oxide. Examples of suitable amphoteric surface active agents are derivatives of aliphatic secondary or tertiary amines in which one of the aliphatic substituents contains from about 8 to 18 carbon atoms and one contains an anionic water solubilizing group, e.g., sulfate or sulfonate. Specific suitable amphoteric surface active agents are 3-dodecylaminopropionate and sodium 3-dodecylaminopropanesulfonate. Examples of suitable zwitterionic surface active agents are derivatives of aliphatic quaternary ammonium compounds in which one of the aliphatic constituents contains from about 8 to 18 carbon atoms and one contains an anionic water solubilizing group. Specific examples of zwitterionic surface active agents are 3-(N,N-dimethyl-N-hexadecylammonio) propane-1-sulfonate and 3-(N,N-dimethyl-N-hexadecylammonio)-2-hydroxy propane-1-sulfonate.

Understanding of the invention will be further enhanced by referring to the following illustrative but non-limiting examples.

EXAMPLE 1

Illustrating the preparation of the stain-release agent

In accordance with the method of Example 3 of U.S. Pat. No. 4,052,368, a 1000 ml three-necked round bottom flask equipped with a sealed stirrer, thermometer, reflux condenser and means for reducing pressure was charged with

| | |
|---|---|
| 88.8g (30 mole %) | dimethyl sodium sulfoisophthalate, |
| 135.8g (70 mole %) | dimethyl terephthalate, |
| 124g (200 mole %) | ethylene glycol, |
| 0.5g | antimony trioxide, |
| 0.5g | zinc acetate, and |
| 1.0g | sodium acetate. |

The mixture was stirred and heated to 155° C. and maintained at 155° to 180° C. for about 2 hours while methanol distilled. The temperature was then raised to 230° C. and the pressure in the flask reduced to 0.5 Torr or lower, whereon ethylene glycol distilled, about 62 g being collected. The temperature was then raised to 250° C. where it was held for 1.5 hours after which the system was brought to atmospheric pressure with dry nitrogen and the reaction product drained from the flask into a polytetrafluoroethylene pan and allowed to cool. The resulting polyester was a tough, clear, essentially colorless water-dispellable resin having a glass transition temperature of 58° C. and exhibited no crystallinity detectable by birefringence.

EXAMPLES 2–19

Following the general process of Example 1, a series of sulfopolyesters were prepared using various ratios of dicarboxylic acids, sulfodicarboxylic acids and glycols. The ratios of the starting materials for each of the sulfopolyesters, whether they were crystalline or not, and their efficacy as stain-release agents for release of stain from dirty motor oil stained 100% polyester fabric are presented in Table I.

Contact of the polyester articles with the stain-release agents of the invention was as follows:

The fabric was wet with water at 55° C., said water containing 0.8% sulfopolyester based on weight of fabric. A chemically active amount of a methyl naphthalene type carrier was added to assist in swelling the polyester. 1% by weight of a dispersed dye, based on the weight of the fabric, was also added. The pH was adjusted to 4.5 with acetic acid. The temperature was then raised to 130° C. and maintained there for 30–45 min. After being rinsed, the wet fabric was then dried at about 150° C. for 5 min.

These examples utilized the following staining, washing, drying and evaluation procedures.

STAINING PROCEDURE

A. Polyester fabric was placed on a blotter.
B. 5 drops of dirty motor oil were dropped on specimen to form a single puddle in the center of specimen.
C. 3×3 inch piece of glassine paper was placed over the puddle of oil.
D. A weight was placed on the film directly over the oil and allowed to set for 60 seconds.
E. The weight and glassine paper were removed.
F. Test specimens were allowed to hang without touching each other for 15 minutes to one hour before laundering.
G. The stained specimen was laundered according to the laboratory laundering procedure.

LABORATORY LAUNDERING PROCEDURE APPARATUS

A. Washer—Top Loading Sears Kenmore Automatic Model 600.
B. Dryer—Sears Kenmore, Model 600.
C. Ballast—4 pounds of approximately 8 ounce fabric were cut into 36″×36″ squares, and hemmed.

SPECIMEN

Specimen size was 8″×8″ minimum, 12″×12″ maximum.

WASH PROCEDURE

A. Samples and ballast were placed in the washer. Total weight was 4±0.5 pounds. Ballast weight was not less than 3 pounds. A maximum of 20 stained specimens were washed together.
B. 150 ml (46 grams) Tide laundry detergent (Proctor and Gamble Co.) were added.
C. The wetting and washing conditions were as described above.

DRYING PROCEDURE

A. Samples were removed from washer at end of spin cycle and placed in dryer.
B. Samples were dried at 71° C. for 45 min. in a Sears Kenmore gas dryer, Model 600.
C. Test specimens were rated within 4 hours after drying.

EVALUATION (Modification of AATCC Test Method 130-1977)

A. Black-top table was placed directly in front of viewing board.
B. The Stain Release Replica was mounted on the viewing board 45 inches above floor.
C. The test specimen was placed flat in the center of the black-topped table.
D. The viewing distance was 30 inches measured from the black mounting board 35 inches above the floor with the eye at 62±6 inches from the floor. An observer visually rated this stained specimen by comparing to the Replica and reported to the nearest 0.5 rating. (The rating scale used is described in footnote (j) to TABLE I.)

TABLE I (all polymers applied at 0.8% solids on fibers)
Efficacy of Stain-Release Polymers

| Example No. | Mole-% Residues of Aromatic dicarboxylic Acid[a] | Mole-% Residues of Sulfodicarboxylic Acid[b] | Mole-% Residues of Aliphatic dicarboxylic Acid[d] | Mole-% Residues of First Glycol[g] | Mole-% Residues Second Glycol | Polyester Crystallinity[i] | Stain-Release Efficacy[j] 1L | 5L | 10L | 30L |
|---|---|---|---|---|---|---|---|---|---|---|
| 1 | 70 | 30 | 0 | 100 | | No | 5 | 4.5 | 4.5 | |
| 2 | 67 | 13 | 20 | 100 | | No | 5 | 5 | 4.5 | |
| 3 | 67 | 13 | 20[e] | 100 | | No | 5 | 5 | 5 | |
| 4 | 65 | 15 | 20 | 100 | | No | 5 | 5 | 5 | 3 |
| 5 | 65 | 15 | 20 | 80 | 20[h] | No | 5 | 4.5 | 4.0 | |
| 6 | 65 | 15 | 20[f] | 100 | | No | 5 | 5 | 5 | |
| 7 | 55 | 35 | 10 | 100 | | No | 4.5 | 4 | 4 | |

TABLE I-continued (all polymers applied at 0.8% solids on fibers)
Efficacy of Stain-Release Polymers

| Example No. | Mole-% Residues of Aromatic dicarboxylic Acid[a] | Mole-% Residues of Sulfodicarboxylic Acid[b] | Mole-% Residues of Aliphatic dicarboxylic Acid[d] | Mole-% Residues of First Glycol[g] | Mole-% Residues Second Glycol | Polyester Crystallinity[i] | Stain-Release Efficacy[j] 1L | 5L | 10L | 30L |
|---|---|---|---|---|---|---|---|---|---|---|
| 8 | 55 | 25 | 20 | 100 | | No | 5 | 5 | 5 | |
| 9 | 45.5 | 14.5[c] | 40 | 100 | | No | 5 | 5 | 5 | |
| 10 | 45 | 35 | 20 | 100 | | No | 4.5 | 4.5 | 4.5 | |
| 11 | 45 | 20 | 35 | 100 | | No | 5 | 4 | 4 | |
| 12 | 45 | 10 | 45 | 100 | | No | 4 | 4 | 4 | |
| 13 | 25 | 35 | 40 | 100 | | No | 4.5 | 1 | | |
| 14 | 25 | 10 | 65 | 100 | | No | 2.5 | 1 | | |
| 15 | 10 | 15 | 75 | 100 | | No | 1 | | | |
| 16 | 92[k] | 8 | 0 | 100 | | No | 1 | | | |
| 17 | 80 | 10 | 10 | 100 | | Yes | (1) | | | |
| 18 | 75 | 15 | 10 | 100 | | Yes | (1) | | | |
| 19 | 75 | 10 | 15 | 100 | | Yes | (1) | | | |

[a]Terephthalic acid residue unless otherwise noted
[b]5-Sulfoisophthalic acid sodium salt residue unless otherwise noted
[c]Residue from sodium sulfosuccinic acid
[d]Residue from adipic acid
[e]Residue from azelaic acid
[f]Residue from sebacic acid
[g]Residue from ethylene glycol
[h]Residue from diethylene glycol
[i]As determined by birefringence
[j]Figure of merit designating the results from 1 wash (IL), 5 washes (5L), 10 washes (10L) and 30 washes (30L) respectively on a scale of 1 to 5, the number 5 indicating complete removal of dirty motor oil stain and 1 indicating no removal of stain
[k]Residue from isophthalic acid
[l]Polyester is not dispellable in wash water
L means laundering(s)

Examples 1–12 show that polyester fabric is afforded excellent stain-release properties through many washes throughout the ranges of sulfopolyesters claimed. Example 4 shows that a preferred composition of the invention is effective through 30 washes. Examples 13–15 show that non-crystalline polyesters having a terephthalic acid content outside the desired range of 30 to 70 mole percent retain stain-release character through less than 5 washes. Example 16, utilizing 92 mole percent isophthalic acid and no terephthalic acid, does not provide stain-release character. Examples 17–19 utilized polymers prepared from over 70% terephthalic acid. The crystalline polymers formed were not dispellable in water under conditions which dispelled the non-crystalline polymers of the present invention, and hence the crystalline polymers were not useful in the present invention.

Additional examination of some of the compounds of Examples 1–16 in all instances showed lack of crystallinity. This examination was effected by x-ray diffraction and differential scanning calorimetric techniques.

EXAMPLES 20–28

TABLE II

Stain-Release
Prior Art Composition

| Example No. | Stain-Release Agent | 1L | 5L | 10L | 15L | 20L | 25L |
|---|---|---|---|---|---|---|---|
| 20 | ZELCON® 4887 (Dupont Corp. crystalline polyoxyalkylene type stain-release agent) .2% SOF (solids on fibers) | 5 | 5 | 1.5 | 1.0 | | |
| 21 | MILEASE T® (Imperial Chemical Industries Ltd. crystalline polyoxyalkylene type stain-release agent) .2% SOF | 5 | 1.5 | 1.0 | | | |
| 22 | NON-CRYSTALLINE POLYMER (Example 4, TABLE I) .2% SOF | 5 | 5 | 4 | 1.5 | 1.0 | |
| 23 | ZELCON® 4887 .5% SOF | 5 | 5 | 5 | 3.5 | 2.0 | 1.5 |
| 24 | MILEASE T® .5% SOF | 5 | 4 | 1 | | | |
| 25 | NON-CRYSTALLINE POLYMER (Example 4, TABLE I) .5% SOF | 5 | 5 | 4.5 | 4 | 3.5 | 2 |
| 26 | ZELCON® 4887 .7% SOF | 5 | 5 | 3 | 2.5 | 1.5 | 1 |
| 27 | MILEASE T® .7% SOF | 5 | 5 | 1 | | | |
| 28 | NON-CRYSTALLINE POLYMER (Example 4, TABLE I) | 5 | 5 | 5 | 4.5 | 4 | 3.5 |

TABLE II-continued

| Example No. | Stain-Release Agent | Stain-Release Prior Art Composition 1L | 5L | 10L | 15L | 20L | 25L |
|---|---|---|---|---|---|---|---|
| | .7% SOF | | | | | | |

These examples show the superior durability to multiple washings of the non-crystalline stain-release agents of the present invention compared to equal concentrations of crystalline prior art stain-release polymers.

What is claimed is as follows:

1. A shaped essentially polyester article which is provided with a surface-modification to provide said article with stain-release properties, said surface-modification comprising the application of a polyester polymer to said surface, said polymer having become locked into and onto said article by application in an aqueous swelling environment of at least 35° C. and remaining in and on said polyester article after 5 washing cycles in an aqueous detergent bath and comprising a water-dispellable non-crystalline polyester polymer having a molecular weight of about 700–50,000 and containing substantially equimolar amounts of the residues of a. 100 mole percent of dicarboxylic acids consisting essentially of
   1. 0 to 65 mole percent aliphatic dicarboxylic acids have at least two carbon atoms between carbonyl groups and having an average of 4 to 10 carbon atoms,
   2. 30 to 90 mole percent unsulfonated aromatic dicarboxylic acids of which at least 30 but no more than 70 mole percent is terephthalic acid,
   3. 5 to 60 mole percent of aliphatic or aromatic dicarboxylic acids having 4 to 12 carbon atoms and having one sulfonic acid or sulfinci acid salt group, and b. 100 mole percent of glycols consisting essentially of aliphatic glycols containing 2 to 10 carbon atoms and up to 4 non-peroxidic catenary oxygen atoms, of which glycols at least 30 mole percent is ethylene glycol.

2. A shaped article according to claim 1 wherein said surface-modification comprises 0 to 45 mole percent aliphatic dicarboxylic acids.

3. A shaped article according to claim 1 wherein said surface-modification comprises 40 to 70 mole percent unsulfonated aromatic dicarboxylic acids.

4. A shaped article according to claim 1 wherein said surface-modification comprises 15 to 40 mole percent sulfonic acid-containing or sulfonic acid salt group-containing dicarboxylic acids.

5. A process for providing a shaped essentially polyester article with a surface-modification to provide said article with stain-release properties comprising said water-dispellable non-crystalline organic polyester polymers having at least 30 but no more than 70 mole percent of ethylene terephthalate units, a molecular weight of about 700 to 50,000, and one equivalent weight of sulfonic acid or ionizable sulfonic acid salt group per 700 to 8000 grams, said process comprising, subjecting an essentially shaped polyester article to an aqueous swelling environment having a temperature of at least 35° C. under conditions sufficient to cause swelling of at least the surface of the shaped article, while said shaped article is in intimate contact with a water-dispellable non-crystalline polymeric compound, and to cause said polymeric compound to remain in and on said polyester article with sufficient strength so as to provide said article with durability to at least 5 washing cycles in an aqueous detergent bath, said polymeric compound being characterized in that it contains substantially equimolar amounts of the residues of, a. 100 mole percent of dicarboxylic acids consisting essentially of,
   1. 0 to 65 mole percent aliphatic dicarboxylic acids having at least two carbon atoms between carbonyl groups and having an average of 4 to 10 carbon atoms,
   2. 30 to 90 mole percent unsulfonated aromatic dicarboxylic acids of which at least 30 but no more than 70 mole percent is terephthalic acid,
   3. 5 to 60 mole percent of aliphatic or aromatic dicarboxylic acids having 4 to 12 carbon atoms and having one sulfonic acid or sulfonic acid salt group, and b. 100 mole percent of glycols consisting essentially of aliphatic glycols containing 2 to 10 carbon atoms and up to 4 nonperoxidic catenary oxygen atoms, of which glycols at least 30 mole percent is ethylene glycol.

6. A process according to claim 5 wherein said polymeric compound comprises 0 to 45 mole percent aliphatic dicarboxylic acids.

7. A process according to claim 5 wherein said polymeric compound comprises 40 to 70 mole percent unsulfonated aromatic dicarboxylic acids.

8. A process according to claim 5 wherein said polymeric compound comprises 15 to 40 mole percent sulfonic acid-containing or sulfonic acid salt group-containing dicarboxylic acids.

9. A process according to claim 5 wherein said aqueous swelling environment further comprises a chemically effective amount of a polyester swelling agent.

10. A process according to claim 5 wherein the temperature of said aqueous swelling environment is between 35° C. and about 150° C.

11. A process according to claim 5 wherein said aqueous swelling environment is a textile washing bath.

12. A process according to claim 5 wherein said aqueous swelling environment is a dyeing bath.

13. A process according to claim 5 wherein said aqueous swelling environment is a padding followed by steaming operation.

14. A process according to claim 5 wherein the contact time between the shaped article and the polymeric compound in the aqueous swelling environment is from about 10 seconds to many hours.

15. A process according to claim 5 wherein about 0.1 to 1.0 part by weight of polymeric compound is contacted with 100 parts by weight of shaped polyester article.

16. A process according to claim 5 wherein 0.05 to 1.0 part by weight of polymeric compound is contacted with 100 parts per weight of shaped polyester article.

17. A process according to claim 5 wherein 0.3 to 0.8 part by weight of polymeric compound is contacted with 100 parts per weight of shaped polyester article.

18. A process according to claim 5 wherein said aqeuous swelling environment comprises about 3 to about 35 parts by weight water per part by weight shaped polyester article.

19. A process according to claim 5 wherein said aqueous swelling environment comprises about 8 to about 15 parts by weight water per part by weight shaped polyester article.

20. A process according to claim 5 wherein the water-dispellable non-crystalline compound comprises 67 mole percent residue of terephthalic acid, 13 mole percent residue of 5-sulfoisophthalic acid sodium salt, 20 mole percent residue of adipic acid and 100 mole percent residue of ethylene glycol.

21. A process according to claim 5 wherein the water-dispellable non-crystalline compound comprises 67 mole percent residue of terephthalic acid, 13 mole percent residue of 5-sulfoisophthalic acid sodium salt and 20 mole percent residue of azelaic acid.

22. A process according to claim 5 wherein the water-dispellable non-crystalline compound comprises 65 mole percent residue of terephthalic acid, 15 mole percent residue of 5-sulfoisophthalic acid sodium salt, 20 mole percent residue of adipic acid and 100 mole percent residue of ethylene glycol.

23. A process according to claim 5 wherein said aqueous swelling environment further includes dyeing assists, adjuvants and surfactants.

24. A shaped essentially polyester article which is provided with a surface-modification to provide said article with stain-release properties, said surface-modification comprising the application of a polyester polymer to said surface, said polymer comprising a water-dispellable non-crystalline polyester polymer having a molecular weight of about 700–50,000 and containing substantially equimolar amounts of the residues of a. 100 mole percent of dicarboxylic acids consisting essentially of
   1. 0 to 65 mole percent aliphatic dicarboxylic acids having at least two carbon atoms between carbonyl groups and having an average of 4 to 10 carbon atoms,
   2. 30 to 90 mole percent unsulfonated aromatic dicarboxylic acids of which at least 30 but no more than 70 mole percent is terephthalic acid,
   3. 5 to 60 mole percent of aliphatic or aromatic dicarboxylic acids having 4 to 12 carbon atoms and having one sulfonic acid or sulfonic acid salt group, and b. 100 mole percent of glycols consisting essentially of aliphatic glycols containing 2 to 10 carbon atoms of which glycols at least 30 mole percent is ethylene glycol.

25. A process for providing a shaped essentially polyester article with a surface-modification to provide said article with stain-release properties comprising water-dispellable non-crystalline organic polyester polymers having at least 30 but no more than 70 mole percent of ethylene terephthalate units, a molecular weight of about 700 to 50,000, and one equivalent weight of sulfonic acid or ionizable sulfonic acid salt group per 700 to 8000 grams, said process comprising, subjecting an essentially shaped polyester article to an aqueous swelling environment under conditions sufficient to cause swelling of at least the surface of the shaped article, while said shaped article is in intimate contact with a water-dispellable non-crystalline polymeric compound, said polymeric compound being characterized in that it contains substantially equimolar amounts of the residues of, a. 100 mole percent of dicarboxylic acids consisting essentially of,
   1. 0 to 65 mole percent aliphatic dicarboxylic acids having at least two carbon atoms between carbonyl groups and having an average of 4 to 10 carbon atoms,
   2. 30 to 90 mole percent unsulfonated aromatic dicarboxylic acids of which at least 30 but no more than 70 mole percent is terephthalic acid,
   3. 5 to 60 mole percent of aliphatic or aromatic dicarboxylic acids having 4 to 12 carbon atoms and having one sulfonic acid or sulfonic acid salt group, and b. 100 mole percent of glycols consisting essentially of aliphatic glycols containing 2 to 10 carbon atoms of which glycols at least 30 mole percent is ethylene glycol.

* * * * *